United States Patent [19]

Parker

[11] 4,087,071

[45] May 2, 1978

[54] CHAIR HEIGHT LIMIT STOP

[75] Inventor: James A. Parker, Orange, Mass.

[73] Assignee: Collier-Keyworth Company, Gardner, Mass.

[21] Appl. No.: 766,627

[22] Filed: Feb. 7, 1977

[51] Int. Cl.[2] ..... F16M 11/24

[52] U.S. Cl. ..... 248/406

[58] Field of Search ..... 248/406, 405; 85/8.8, 85/8.6; 151/23, 8, 69

[56] References Cited

U.S. PATENT DOCUMENTS

| | | | |
|---|---|---|---|
| 585,435 | 6/1897 | Gilson | 248/405 |
| 1,217,268 | 2/1917 | Bolens | 248/406 |
| 1,501,180 | 7/1924 | Peters et al. | 248/405 |
| 1,711,018 | 4/1929 | Ellis et al. | 85/8.6 |
| 1,779,204 | 10/1930 | Andersen | 85/8.6 |
| 2,897,022 | 7/1959 | Marola | 85/8.8 |
| 3,062,253 | 11/1962 | Millheiser | 151/69 |
| 3,214,204 | 10/1965 | Carter | 85/8.8 |
| 3,289,726 | 12/1966 | Sauter | 85/8.8 |
| 3,391,893 | 7/1968 | Doerner | 248/405 |
| 3,606,234 | 9/1971 | Prescott | 248/406 |

*Primary Examiner*—Marion Parsons, Jr.

[57] ABSTRACT

Limit stop means for limiting vertical height adjustment of a swivel chair support comprising a spindle, a fixture on one end of the spindle for connection to a chair seat, the upper end of the spindle threaded and having a load supporting adjustment nut thereon, and a keyway along the threaded portion of the spindle terminating below the nut at a position spaced from the lower end of the spindle, the limit stop means comprising a resiliently deformable split ring washer having a key extending inwardly therefrom adapted by deformation for assembly with said chair support over the spindle to a position between said nut and the lower end of the keyway with said key in said keyway and separate retainer means for restraining said washer against deformation.

7 Claims, 7 Drawing Figures

FIG 1
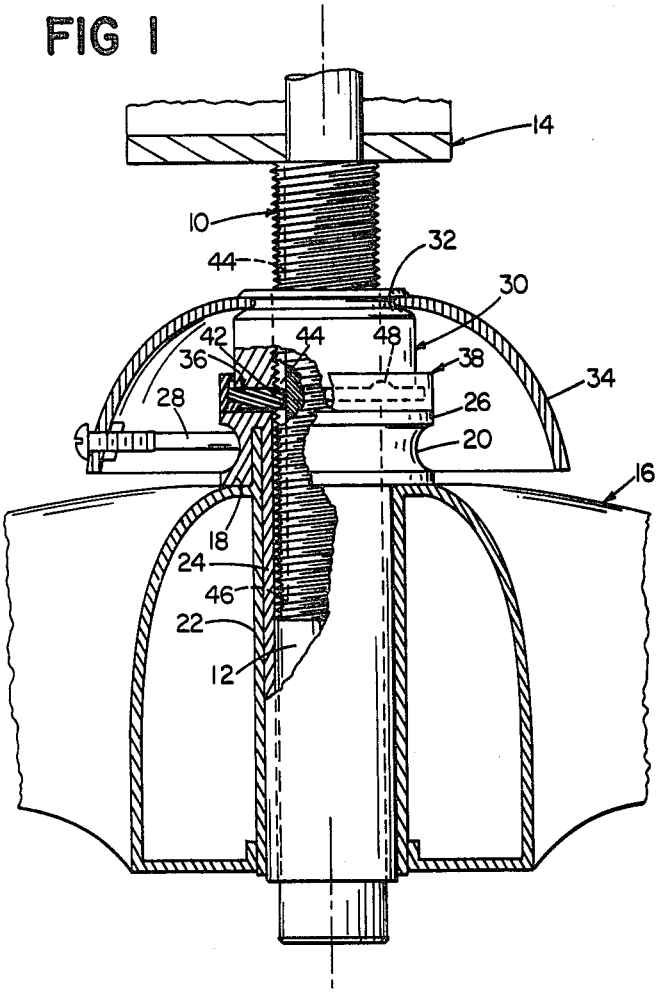
FIG 2
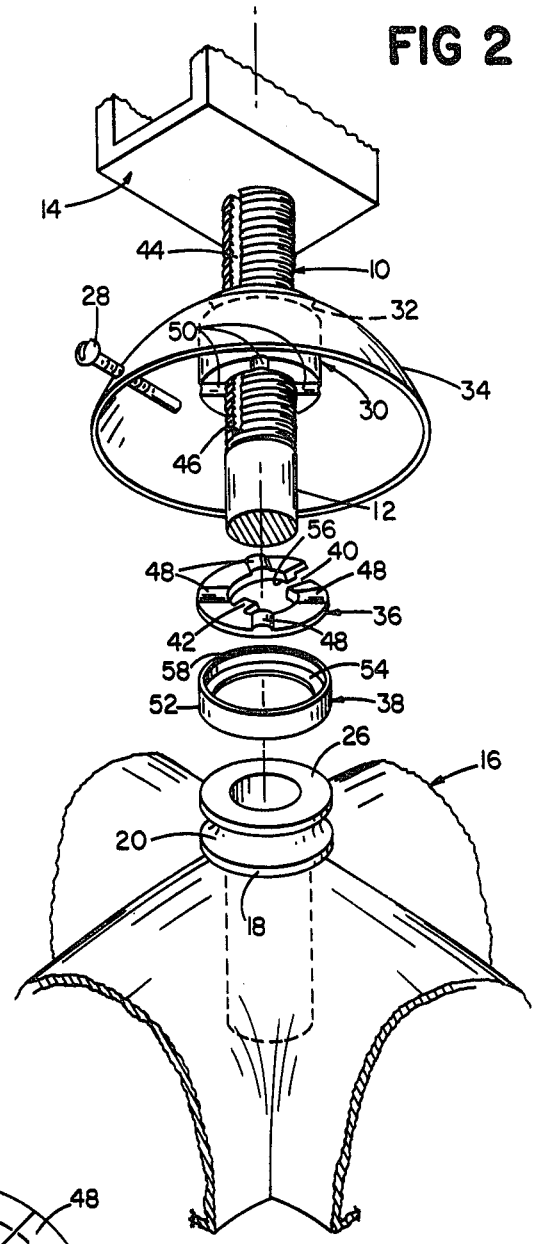
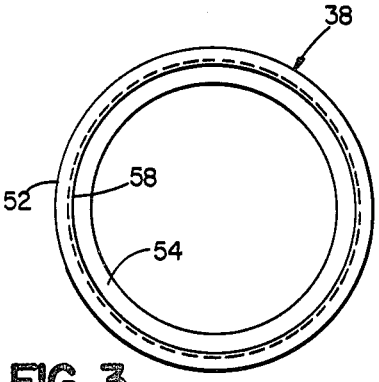
FIG 3
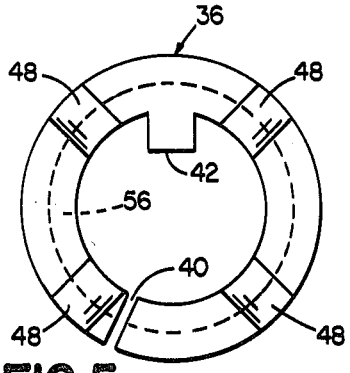
FIG 5
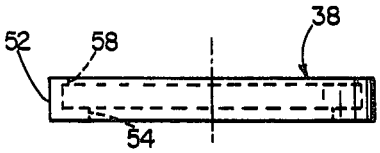
FIG 4
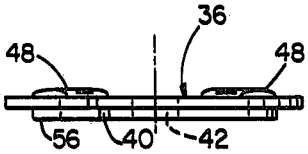
FIG 6
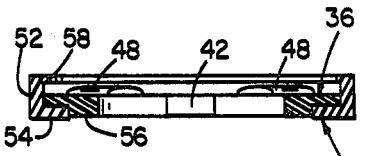
FIG 7

CHAIR HEIGHT LIMIT STOP

This invention relates to a swivel chair support construction of the threaded spindle type in which a seat height adjustment handwheel, or "bell", is used, and more particularly to a novel and improved construction for limiting height adjustment of the spindle and the chair seat.

Typically, such swivel chair support constructions employ a fitting secured to the upper end of the spindle and arranged to be attached to a variety of chair seats. The spindle has a threaded upper portion on which the bell connected to a load bearing adjustment nut is threaded for use in adjusting the height of the chair.

In certain swivel chair arrangements, as shown for example in U.S. Pat. No. 3,606,234, a keyway is provided on the spindle, extending in an axial direction from the upper end of the spindle along the threaded portion and terminating adjacent the junction of the threaded and unthreaded portions of the spindle. A washer embracing the threaded portion of the spindle is provided with a key extending into the keyway and limits upward adjustment of the spindle by the engagement of the key with the bottom of the keyway, thereby to limit upward chair adjustment to a safe height beyond which the chair might tend to topple.

In the prior art, either the washer must be placed on the spindle first, the adjustment nut and bell being assembled on the spindle thereafter and the spindle being then attached with its upper end fitting to the chair seat, or a deformable split washer must be utilized for placement on the spindle after the bell and nut are threaded thereon. Thereafter the assembly is fitted on one of a variety of leg assemblies, selected for color or style or the like. Unfortunately, the assembly of the washer first in the sequence of assembly operations presents problems. If, for instance, the washer is inadvertently omitted, it is necessary to disassemble the chair seat from the spindle and fitting and to remove the fitting bell in order to place the washer in position; the parts must then be reassembled. These additional steps entail the possibility of damage to the chair seat in addition to the labor required for disassembly and reassembly. Deformable split washers likewise have been found to have problems in that upon engagement of the washer key with the bottom of the keyway, the washer may be deformed and accidentally removed permitting chair seat adjustment to an unsafe height.

It is accordingly an object of the present invention to provide for a swivel support construction, a limit stop washer assembly which may be assembled to the spindle after connection of the bell to the spindle and which is secure against accidental removal after assembly. It is yet a further object to provide a washer assembly which is durable and which is relatively simple and inexpensive to manufacture.

In general, the invention features limit stop means comprising, in combination, a split ring washer, having an inwardly extending key, and a retainer for assembly with the washer. The washer has an inner diameter corresponding to the diameter of a chair support spindle and is resiliently deformable to permit passage of the washer around the spindle to a keyway spaced from the spindle lower end. Preferably, the split in the ring is placed opposite the key. The retainer is annular and engages the washer when on the spindle, the retainer restraining the washer from deformation. The retainer comprises a flange having an inner diameter larger than the diameter of the spindle and a cylindrical wall of approximately the same diameter as the washer within which the washer is positioned. Preferably a lip on the cylindrical wall retains the washer within the retainer.

The washer with the retainer is assembled on a chair support spindle with the key in a keyway between a load supporting adjustment nut and the bottom end of the keyway. As the nut adjusts the spindle upwardly, the key eventually engages the bottom of the keyway end preventing further upward adjustment.

Other objects, features and advantages will become apparent from the following description of a preferred embodiment of the invention, taken together with the accompanying drawings thereof, in which:

FIG. 1 is a view in side elevation, partly broken away and in cross-section, of a swivel chair support construction in accordance with the invention;

FIG. 2 is an exploded perspective view of a portion of the construction shown in FIG. 1;

FIGS. 3 and 4 are, respectively, enlarged plan and side elevation views of the retainer employed with the washer as illustrated in FIGS. 1 and 2;

FIGS. 5 and 6 are, respectively, enlarged plan and side elevation views of the washer illustrated in FIGS. 1 and 2; and FIG. 7 is an enlarged sectional view of the assembled retainer and washer.

Referring to FIGS. 1 and 2 the limit stop means are employed with a chair support construction having a threaded spindle 10 which has a lower smooth cylindrical bearing surface 12. The upper end of spindle 10 is secured in any suitable manner, preferably by non-detachable staking, to a conventional fitting 14 which is arranged to be secured to the bottom of a chair seat and which may provide for tilting of the chair seat if desired. Leg assembly 16 is provided with a bearing for supporting the spindle. The bearing includes a washer 18 rigidly fastened to and seated on top of leg assembly 16 and a flanged steel support collar 20 which is rigidly fastened to washer 18 and held in place by a swaged steel tube 22. Mounted within tube 22 is a bearing liner 24 of synthetic plastic composition supported on collar 20 by means of radially extending flange 26 which is formed integrally with liner 24 and which serves as a load bearing element. While a variety of materials such as synthetic plastic compositions are suitable for use in making the bearing liner, as is well known, the material preferred for best results is a superpolyamide. While the length of lower unthreaded portion 12 of spindle 10 is not critical, it is preferred that it be at least half the length of bearing liner 24.

A load supporting adjustment nut 30 is engaged with the threads on spindle 10 and has an annular recess 32 near the top thereof. Bell 34 may be of any conventional size or shape to match the leg assembly 16 and has a center opening in the top thereof arranged to be swaged in place in recess 32 around nut 30 in fixed engagement therewith. Set screw 28 extends through the side of bell 34 for engagement with collar 20 radially inwardly of flange 26 for connecting the upper assembly to the leg assembly 16.

Limit stop means in the form of a washer 36 and retainer 38 is arranged to be mounted around spindle 10 between nut 30 and flange 26. Referring to FIGS. 5–7, washer 36 is split at 40, has an inner diameter corresponding to that of and adapted to slip over spindle 10, and has a key 42 generally opposite split 40 extending radially inwardly from the inner diameter for cooperative engagement with vertically extending keyway 44 vertically extending along the threaded upper portion of spindle 10 and terminating at a bottom end 46 adjacent the junction of the threads and the smooth surface of the spindle 10. Four detents 48 spaced apart 90° and raised 0.03 inch above the upper surface of washer 36 are provided to seat in corresponding indents or recesses 50, shown best in FIG. 2, in the bottom of nut 30 to restrain rotation of nut 30 on spindle 10. The outer diameter of washer 36 corresponds to the inner diameter of retainer 38.

Retainer 38, shown in detail in FIGS. 3, 4 and 7, comprises a cylindrical wall portion 52 having an outer diameter corresponding generally to the diameter of flange 26 and an inner diameter corresponding to the outer diameter of washer 36. Integral with the bottom of wall 52, a radial wall or flange 54 extends inwardly to a central aperture having a diameter larger than the inner diameter of washer 36 adapted to receive a flange portion 56 of washer 36 extending axially from the washer bottom a distance slightly smaller, e.g. 0.001 inch, than the thickness of flange 54. The upper inner edge of retainer 38 includes a lip 58 having an inner diameter smaller than the outer diameter of washer 36 but as large as the outer diameter of nut 30 whereby the nut 30 may fit within retainer 38. The height of wall 52 inside retainer is greater than the washer thickness outwardly of flange 56.

Washer 36 is made of strong, resilient material. Preferably, both washer 36 and retainer 38 are made of organic plastic material, i.e., nylon, which is both strong and resilient and which has a low coefficient of friction facilitating rotation with spindle 10 on flange 26.

The support structure is assembled by first threading nut 30 with attached bell 34 on the threaded upper portion of spindle 10. The spindle is then attached to fitting 14 which may then or later be connected to a chair seat. In an alternate embodiment, not shown, the spindle is threaded along its entire length and may be attached to a fitting before assembly with nut 30. In any event, with nut 30 assembled on the threaded upper portion of spindle 10, the limit stop means is placed on the spindle 10 at any time prior to the connection of spindle 10 to leg assembly 16. Washer 36 is deformed as in FIG. 2 and is slipped around the spindle 10 until key 42 engages keyway 44; the washer is then released to assume its normal configuration extending about spindle 10. Retainer 38 is then slipped over the lower end of spindle 10 to washer 36 which is snapped, by compression of the split 40, past lip 58 which is then located in retainer 38 with flange 56 centered in the aperture defined by flange 54. Spindle 10 is then inserted into tube 24 of the leg assembly 16 with retainer 38 supported on flange 26 and nut 30 supported on washer 36 within the cylindrical wall 52 of retainer 38. Set screw 28 is tightened to fit within the arcuate portion of collar 20 to secure the assemblies together.

The detents 48 on washer 36 and indents 50 in the bottom of nut 30 cooperate to prevent, absent adjustment, seat height from changing over an extended period of use of the chair since they, together with key 42, tend to prevent rotation of the nut 30 with respect to spindle 10 and cause relative rotation to occur between the bottom of washer 36 and the flange 26 of bearing liner 24 when the chair seat is rotated on the leg assembly 16. To adjust seat height, bell 34 together with nut 30 are rotated until the seat is at the right height, the detents 48 riding into and out of engagement with indents 50 during the adjustment. Bell 34 conceals the other elements and presents an aesthetic appearance.

As chair height is adjusted upwardly key 42 eventually engages the bottom 46 of keyway 44. This engagement of key 42 with the keyway bottom 46 prevents chair adjustment above a predetermined height. Retainer 38 positively secures the split ring washer 36 from accidental removal from spindle 10, particularly when key 42 engages the keyway bottom 46.

Other embodiments of this invention will occur to those skilled in the art which are within the scope of the following claims.

What is claimed is:

1. A swivel chair support construction comprising:

a spindle having one end adapted for attachment to a chair seat, at least the upper portion of said spindle being threaded for a sufficient distance to provide vertical adjustability of the chair position;

a load supporting nut threadedly engaged on said spindle;

a keyway extending along the threaded portion of said spindle and terminating at a lower end below said nut a distance spaced above the lower end of said spindle; and limit stop means engaging said keyway between said nut and the keyway lower end;

the improvement in which said limit stop means comprises:

a split ring washer on said spindle having an inner diameter corresponding to the diameter of said spindle and having a key extending into said keyway, said washer being resiliently deformable for assembly and disassembly about said spindle; and an annular retainer member engageable with said washer for restraining said washer against deformation, said annular retainer comprising a flange disposed under said washer, said flange having an inner diameter at least as large as the diameter of said spindle and said retainer having an integral cylindrical wall extending upwardly from said retainer around said washer, said cylindrical wall having an inner diameter corresponding to said washer outer diameter.

2. The chair support claimed in claim 1 in which said retainer has an inwardly extending lip extending inwardly from said cylindrical wall spaced from said retainer flange and having an inner diameter smaller than the normal outer diameter of said washer and larger than the outer diameter of said washer compressed to close the split in said washer whereby said washer may be positively retained in said retainer between said retainer lip and said retainer flange.

3. The chair support claimed in claim 2 in which said washer further comprises an axially extending flange having an outer diameter smaller than the inner diameter of said retainer flange and an axial dimension no greater than the axial dimension of said retainer flange.

4. The chair support claimed in claim 2 in which the split in said ring is positioned approximately opposite said key.

5. Limit stop means for use in swivel chair support assembly comprising a spindle threaded at least at the upper end thereof, a keyway extending along the threaded portion of said spindle which keyway terminates at a keyway bottom spaced from the other end of said spindle, and an adjusting nut on the spindle threaded portion positioned along the keyway spaced from said keyway bottom, said limit stop means comprising, in combination:

a resiliently deformable split ring washer having an inner diameter corresponding to the diameter of said spindle and having a key extending radially inwardly from the washer inner diameter said key adapted for engagement with said keyway; and a retainer comprising a flange having an inner diameter larger than the diameter of said spindle and smaller than the outer diameter of said washer, and a cylindrical wall integral with said flange and having an inner diameter substantially equal to the washer outer diameter;

said retainer having an inwardly extending lip extending inwardly from said cylindrical wall spaced from said retainer flange and having an inner diameter smaller than the normal outer diameter of said washer and larger than the outer diameter of said washer compressed to close the split in said washer whereby said washer may be positively retained in said retainer between said retainer lip and said retainer flange;

whereby said washer may be deformed for assembly about said spindle to place said key in said keyway; and said retainer assembled with said washer restrains said washer from deforming.

6. The washer-retainer combination claimed in claim 5 in which the split in said ring is positioned approximately opposite said key.

7. The washer-retainer combination claimed in claim 5 in which said washer further comprises an axially extending flange having an outer diameter smaller than the inner diameter of said retainer flange and an axial dimension no greater than the axial dimension of said retainer flange.

* * * * *